US011087705B2

(12) United States Patent
Zhou et al.

(10) Patent No.: US 11,087,705 B2
(45) Date of Patent: Aug. 10, 2021

(54) DRIVING CIRCUITRY AND METHOD OF DISPLAY PANEL AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Liugang Zhou, Beijing (CN); Jianming Wang, Beijing (CN); Shou Li, Beijing (CN); Tao Li, Beijing (CN); Yuan Shi, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 525 days.

(21) Appl. No.: 15/776,086

(22) PCT Filed: Aug. 29, 2017

(86) PCT No.: PCT/CN2017/099499
§ 371 (c)(1),
(2) Date: May 15, 2018

(87) PCT Pub. No.: WO2018/126718
PCT Pub. Date: Jul. 12, 2018

(65) Prior Publication Data

US 2020/0388235 A1 Dec. 10, 2020

(30) Foreign Application Priority Data

Jan. 4, 2017 (CN) ..... 201710003406.9

(51) Int. Cl.
*G09G 3/36* (2006.01)

(52) U.S. Cl.
CPC ... *G09G 3/3677* (2013.01); *G09G 2310/0251* (2013.01); *G09G 2310/08* (2013.01); *G09G 2320/02* (2013.01)

(58) Field of Classification Search
None
See application file for complete search history.

(56) References Cited

U.S. PATENT DOCUMENTS 7,164,405 B1 * 1/2007 Jeong ..... G09G 3/3688 345/94
2003/0016189 A1 * 1/2003 Abe ..... G09G 3/2014 345/55

(Continued)

FOREIGN PATENT DOCUMENTS

CN 101071545 A 11/2007
CN 103198803 A 7/2013

(Continued)

OTHER PUBLICATIONS

Second Office Action for Chinese Application No. 201710003406.9, dated Nov. 6, 2018, 6 Pages.

(Continued)

*Primary Examiner* — Benjamin X Casarez
(74) *Attorney, Agent, or Firm* — Brooks Kushman P.C.

(57) ABSTRACT

A driving method of a display panel, a driving circuitry of a display panel and a display device are provided. The display panel includes Y gate lines, the Y gate lines are divided into a plurality of gate line groups based on a scanning sequence of the Y gate lines, and each gate line group includes at least one gate line; the driving method includes: determining an $i^{th}$ gate line to be scanned; adjusting an original charging duration of a scanning signal corresponding to the $i^{th}$ gate line to an adjustment charging duration, where the adjustment charging duration of every gate line in each gate line group are identical, and the (Continued)

adjustment charging durations of respective gate line groups gradually increase in a direction away from a source driver; and outputting the scanning signal corresponding to the $i^{th}$ gate line to the $i^{th}$ gate line, based on the adjustment charging duration of the $i^{th}$ gate line.

9 Claims, 7 Drawing Sheets

(56) References Cited

U.S. PATENT DOCUMENTS

| | | | | |
|---|---|---|---|---|
| 2006/0132422 | A1* | 6/2006 | Teragaki | G09G 3/3648 345/100 |
| 2014/0176407 | A1* | 6/2014 | Choi | G09G 3/3677 345/87 |
| 2016/0042713 | A1 | 2/2016 | Sim et al. | |
| 2016/0111051 | A1* | 4/2016 | Jeon | G09G 3/3674 345/204 |
| 2016/0247470 | A1 | 8/2016 | Tan | |
| 2016/0372071 | A1* | 12/2016 | Ho | G09G 3/3677 |
| 2018/0275472 | A1* | 9/2018 | Sakai | G09G 3/3614 |
| 2018/0330655 | A1* | 11/2018 | Tsuchi | G09G 3/3225 |
| 2019/0392773 | A1* | 12/2019 | Higuchi | G02F 1/136286 |

FOREIGN PATENT DOCUMENTS

| | | | |
|---|---|---|---|
| CN | 103745694 | A | 4/2014 |
| CN | 104361877 | A | 2/2015 |
| CN | 104361878 | A | 2/2015 |
| CN | 105629539 | A | 6/2016 |
| CN | 106875905 | A | 6/2017 |
| KR | 20160017375 | A | 2/2016 |

OTHER PUBLICATIONS

International Search Report and Written Opinion for Application No. PCT/CN2017/099499, dated Nov. 30, 2017, 14 Pages.

* cited by examiner

DRIVING CIRCUITRY AND METHOD OF DISPLAY PANEL AND DISPLAY DEVICE

CROSS-REFERENCE TO RELATED APPLICATION

This application is the U.S. national phase of PCT Application No. PCT/CN2017/099499 filed on Aug. 29, 2017, which claims priority to Chinese Patent Application No. 201710003406.9 filed on Jan. 4, 2017, which are incorporated herein by reference in their entireties.

TECHNICAL FIELD

The present disclosure relates to the field of display technology, and in particular to a driving method of a display panel, a driving circuitry of a display panel and a display device.

BACKGROUND

In the related art, a liquid crystal display device includes a time sequence controller (TCON), a source driver, a gate driver and a display panel. The time sequence controller is used for outputting a clock signal CPV, an enablement signal OE and a frame trigger signal STV to the gate driver. Only when the enablement signal OE is in the ON state, the gate driver charges the pixel row, that is, the duration width of the scan signal output by the gate driver to each gate line is equal to the turn-on time width of the corresponding enablement signal OE. For each pixel row, the turn-on time width of the enable signal received by the gate driver is the same, that is, the charging time for each pixel row is the same, which causes the following problem: the charging rate of the pixel row closer to the source driver is higher, the charging rate of the pixel row farther from the source driver is lower, and the charging rate of the entire surface of the display panel is inconsistent, resulting in a poor display of the screen.

SUMMARY

In view of this, a driving method of a display panel, a driving circuitry of a display panel and a display device are provided in the present disclosure, to solve the above technical issue that the charging rate of the entire surface of the display panel is inconsistent which resulting in a poor display of the screen.

To solve the above technical issue, a driving method of a display panel, where the display panel includes Y gate lines, the Y gate lines are divided into a plurality of gate line groups based on a scanning sequence of the Y gate lines, and each gate line group includes at least one gate line; the driving method includes: determining an $i^{th}$ gate line to be scanned, where $1 \le i \le Y$; adjusting an original charging duration of a scanning signal corresponding to the $i^{th}$ gate line to an adjustment charging duration, where the adjustment charging duration of every gate line in each gate line group are identical, and the adjustment charging durations of respective gate line groups gradually increase in a direction away from a source driver; and outputting the scanning signal corresponding to the $i^{th}$ gate line to the $i^{th}$ gate line, based on the adjustment charging duration of the $i^{th}$ gate line.

Optionally, a sum of the adjustment charging duration of the Y gate lines is identical to a sum of the original charging duration of the Y gate lines.

Optionally, prior to adjusting the original charging duration of the scanning signal corresponding to the $i^{th}$ gate line to the adjustment charging duration, the method further includes: pre-storing the adjustment charging duration of each gate line.

Optionally, the pre-storing the adjustment charging duration of each gate line, further includes: determining a width of H-Blank data of video data corresponding to a $i^{th}$ row of gate lines to be adjusted, to obtain a resultant width of the H-Blank data corresponding to the $i^{th}$ row of gate lines; determining the adjustment charging duration of the $i^{th}$ row of gate lines based on the resultant width of the H-Blank data corresponding to the $i^{th}$ row of gate lines.

Optionally, the determining the width of the H-Blank data of the video data corresponding to the $i^{th}$ row of gate lines to be adjusted, to obtain the resultant width of the H-Blank data corresponding to the $i^{th}$ row of gate lines, further includes: determining a width k0 of the H-Blank data of the video data corresponding to a first row of gate lines to be reduced; calculating a resultant width n(1) of the H-Blank data corresponding to the first row of gate lines, where n(1)=HB−k0; calculating a difference Δk between the resultant width of the H-Blank data corresponding to the $i^{th}$ row of gate lines and n(1), where $$\Delta k = \frac{2mk0}{Y} * \mathrm{int}\left(\frac{i}{m}\right),$$

Y is a total number of the gate lines of the display panel, and m is a total number of the gate line groups; and calculating a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

Optionally, the determining the width of the H-Blank data of the video data corresponding to the $i^{th}$ row of gate lines to be adjusted, to obtain the resultant width of the H-Blank data corresponding to the $i^{th}$ row of gate lines, further includes: determining a width k0 of the H-Blank data of the video data corresponding to a first row of gate lines to be reduced; calculating a resultant width n(1) of the H-Blank data corresponding to the first row of gate lines, where n(1)=HB−k0; calculating a difference Δk between the resultant width of the H-Blank data corresponding to the $i^{th}$ row of gate lines and n(1), where $$\Delta k = \mathrm{int}\left(k0 * \left(\frac{\mathrm{int}\left(\frac{i}{m}\right)}{\mathrm{int}\left(\frac{Y}{m}\right)}\right)^{A}\right),$$

A is an exponent, Y is a total number of the gate lines of the display panel, and m is a total number of the gate line groups; and calculating a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

Optionally, the determining the width k0 of the H-Blank data of the video data corresponding to the first row of gate lines to be reduced, further includes: calculating a width k of the H-Blank data of the video data corresponding to the first row of gate lines to be reduced at best, where $$(NL-1)*X=\frac{1}{2}*k*\frac{Y}{2},$$

NL is a volume of data that one line buffer of a time sequence controller capable of storing, X is a volume of valid data of one line of video data, Y is the total number of the gate lines of the display panel, k<HB, and HB is the width of the H-Blank data of the video data corresponding to the $i^{th}$ row of gate lines; selecting a value smaller than or equal to k as the width k0 of the H-Blank data of the video data corresponding to the first row of gate lines to be reduced.

A driving circuitry of a display panel is further provided in the present disclosure, where the display panel includes Y gate lines, the Y gate lines are divided into a plurality of gate line groups based on a scanning sequence of the Y gate lines, and each gate line group includes at least one gate line; the driving circuitry includes: a determination circuit, configured to determine an $i^{th}$ gate line to be scanned, where $1 \le i \le Y$; an adjustment circuit, configured to adjust an original charging duration of a scanning signal corresponding to the $i^{th}$ gate line to an adjustment charging duration, where the adjustment charging duration of every gate line in each gate line group are identical, and the adjustment charging durations of respective gate line groups gradually increase in a direction away from a source driver; and an output circuit, configured to output the scanning signal corresponding to the $i^{th}$ gate line to the $i^{th}$ gate line, based on the adjustment charging duration of the $i^{th}$ gate line.

Optionally, the driving circuitry of the display panel further comprises: a storage circuit, configured to pre-store the adjustment charging duration of each gate line.

Optionally, the driving circuitry of the display panel further comprises: a H-Blank data width adjustment circuit, configured to determine a width of H-Blank data of video data corresponding to a $i^{th}$ row of gate lines to be adjusted, to obtain a resultant width of the H-Blank data corresponding to the $i^{th}$ row of gate lines; a third determination circuit, configured to determine the adjustment charging duration of the $i^{th}$ row of gate lines based on the resultant width of the H-Blank data corresponding to the $i^{th}$ row of gate lines.

Optionally, the H-Blank data width adjustment circuit further includes: a first determination circuit, configured to determine a width k0 of the H-Blank data of the video data corresponding to a first row of gate lines to be reduced; a first calculation circuit, configured to calculate a resultant width n(1) of the H-Blank data corresponding to the first row of gate lines, where n(1)=HB−k0; a second calculation circuit, configured to calculate a difference Δk between the resultant width of the H-Blank data corresponding to the $i^{th}$ row of gate lines and n(1), where $$\Delta k=\frac{2mk0}{Y}*\mathrm{int}\left(\frac{i}{m}\right),$$

Y is a total number of the gate lines of the display panel, and m is a total number of the gate line groups; and a fourth calculation circuit, configured to calculate a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

Optionally, the H-Blank data width adjustment circuit further includes: a second determination circuit, configured to determine a width k0 of the H-Blank data of the video data corresponding to a first row of gate lines to be reduced; a fifth calculation circuit, configured to calculate a resultant width n(1) of the H-Blank data corresponding to the first row of gate lines, where n(1)=HB−k0; a sixth calculation circuit, configured to calculate a difference Δk between the resultant width of the H-Blank data corresponding to the $i^{th}$ row of gate lines and n(1), where $$\Delta k=\mathrm{int}\left(k0*\left(\frac{\mathrm{int}\left(\frac{i}{m}\right)}{\mathrm{int}\left(\frac{Y}{m}\right)}\right)^{A}\right),$$

A is an exponent, Y is a total number of the gate lines of the display panel, and m is a total number of the gate line groups; and a seventh calculation circuit, configured to calculate a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

Optionally, the storage circuit is further configured to pre-store the adjustment charging duration of each gate line through a table.

A display device is further provided in the present disclosure, including the above driving circuitry of the display panel and further including: a data receiving circuit, configured to receive video data transmitted to the time sequence controller; a line buffer, configured to store the video data; an adjustable formula calculator, configured to calculate a width of H-Blank data of the video data corresponding to each row of gate lines to be adjusted; a data regulation circuit, configured to generate resultant video data based on the width of the H-Blank data of the video data corresponding to each row of gate lines to be adjusted that calculated by the adjustable formula calculator; a time sequence generation circuitry, configured to generate a time sequence control signal based on the resultant video data; and a data output circuit, configured to output video data in response to the time sequence control signal generated by the time sequence generation circuit.

DETAILED DESCRIPTION

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
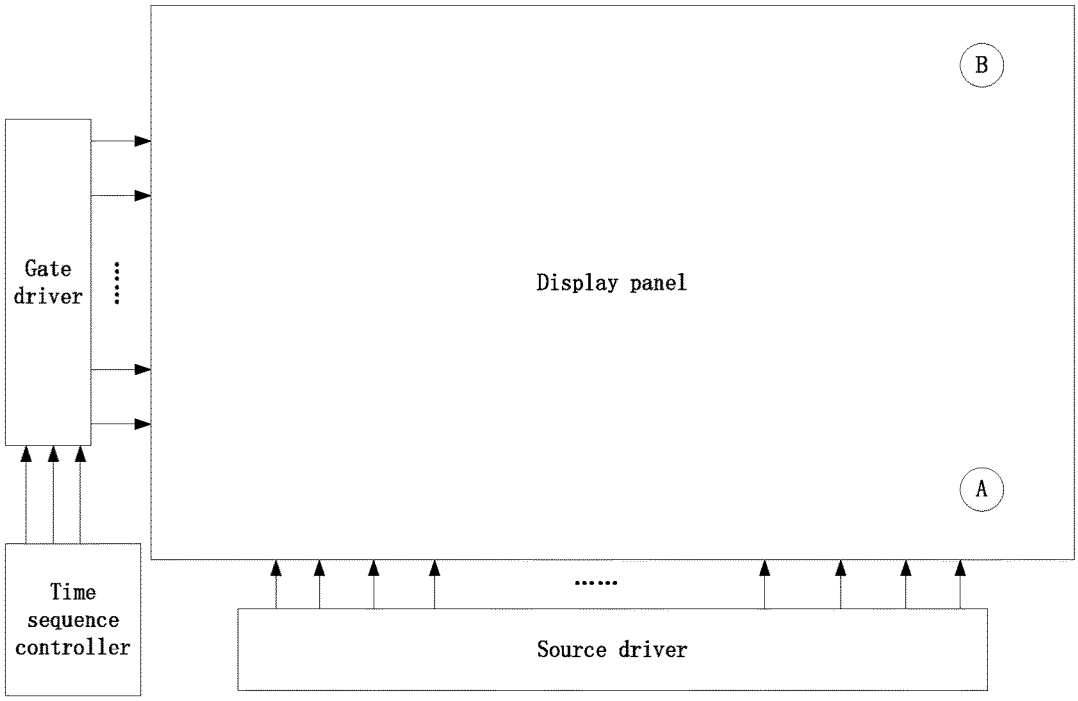
FIG. 1 is a schematic view of a liquid crystal display device in the related art.

In the related art, as shown in FIG. 1, a liquid crystal display device includes a time sequence controller (TCON), a source driver, a gate driver and a display panel. The display panel is provided with lengthways data lines (not shown), transversal gate lines (not shown) and pixel array in the pixel areas defined by the gate lines and data lines. The time sequence controller is used for outputting a clock signal CPV, an enablement signal OE and a frame trigger signal STV to the gate driver, so as to control the gate driver to charge a corresponding pixel in the pixel array through a corresponding gate line, thereby transmitting video data output by the source driver to the corresponding pixel and displaying an image.

In the related art, only when the enablement signal OE is in the ON state, the gate driver charges the pixel row, that is, the duration width of the scan signal output by the gate driver to each gate line is equal to the turn-on time width of the corresponding enablement signal OE. For each pixel row, the turn-on time width of the enable signal received by the gate driver is the same, that is, the charging time for each pixel row is the same, which causes the following problem: the source driver is commonly arranged at a side of the display panel (as shown in FIG. 1), the pixel at the position A of the display panel is closer to the source driver, and the RC delay of the data line is smaller, a charging rate of the pixel is better, and the display image is brighter; while the pixel at the position B of the display panel is farther from the source driver, and the RC delay of the data line is bigger, a charging rate of the pixel is poor, and the display image is darker.

That is, the charging rate of the pixel row closer to the source driver is higher, the charging rate of the pixel row farther from the source driver is lower, and the charging rate of the entire surface of the display panel is inconsistent, resulting in a poor display of the screen.

According to the calculation formula of the charging rate of pixels $$Vt = U * \left(1 - e^{-\frac{t}{RC}}\right), \frac{t}{RC} = -\ln\left(1 - \frac{Vt}{U}\right)$$

is obtained, where U is the voltage, t is the charging time, and Vt is the voltage at time t, that is, there is a linear relationship between t and RC. Therefore, in at least one embodiment of the present disclosure, the charging rate of the pixel is changed by adjusting the charging time of the pixel.

Figure 2:
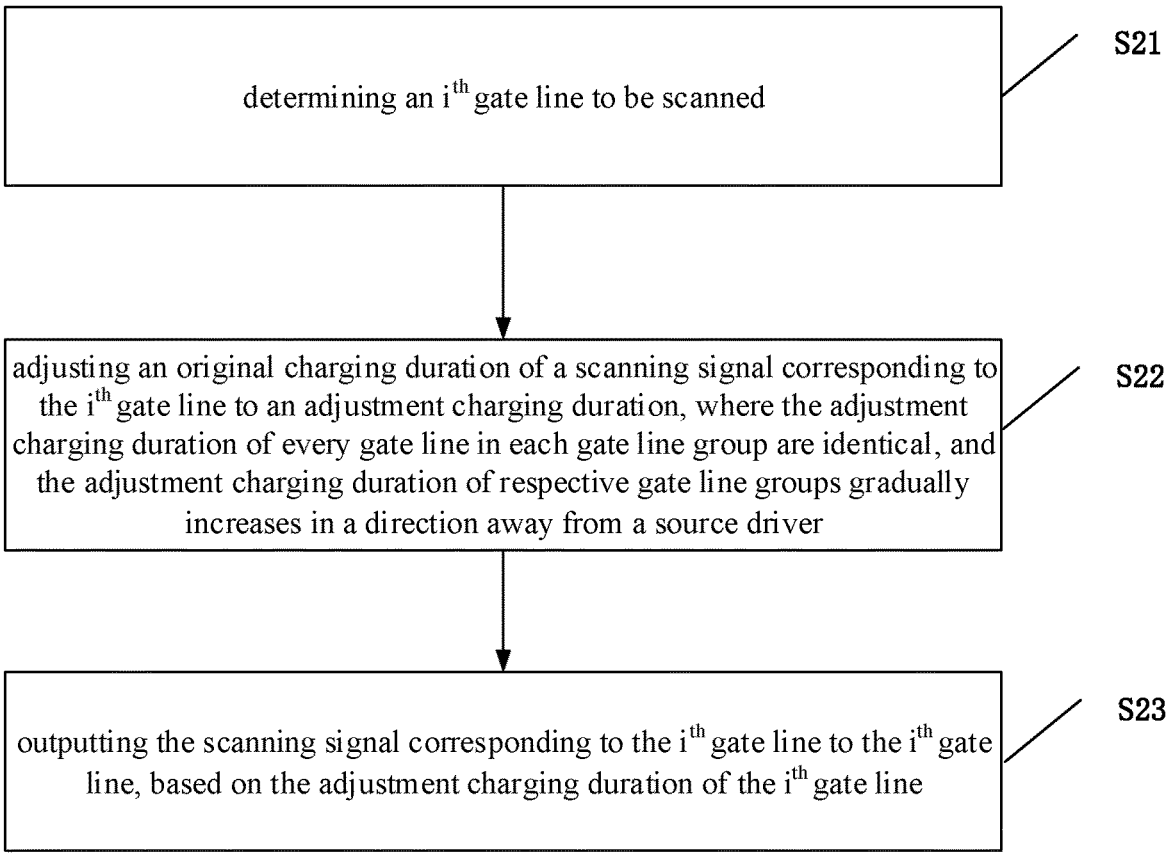
FIG. 2 is a flow chart of a driving method of a display panel in at least one embodiment of the present disclosure.

Referring to FIG. 2, a driving method of a display panel is provided in at least one embodiment of the present disclosure, where the display panel includes Y gate lines (Y is a positive integer), the Y gate lines are divided into a plurality of gate line groups based on a scanning sequence of the Y gate lines, and each gate line group comprises at least one gate line. The driving method includes:

Step S21: determining an $i^{th}$ gate line to be scanned, where $1 \leq i \leq Y$;

Step S22: adjusting an original charging duration of a scanning signal corresponding to the $i^{th}$ gate line to an adjustment charging duration, where the adjustment charging duration of every gate line in each gate line group are identical, and the adjustment charging duration of respective gate line groups gradually increases in a direction away from a source driver; and Step S23: outputting the scanning signal corresponding to the $i^{th}$ gate line to the $i^{th}$ gate line, based on the adjustment charging duration of the $i^{th}$ gate line.

According to at least one embodiment of the present disclosure, the charging duration corresponding to each row of gate lines is adjusted so that the charging duration of the pixel rows near the source driver is short, and the charging duration of the pixel rows far from the source driver is larger, thereby improving the insufficient charging rate of the pixel rows, to enable the charging rate of every row of pixels to be the same or similar, thereby solving the poor display of the screen caused by the difference in the charging rate on the display panel and improving the display effect.

Figure 3:
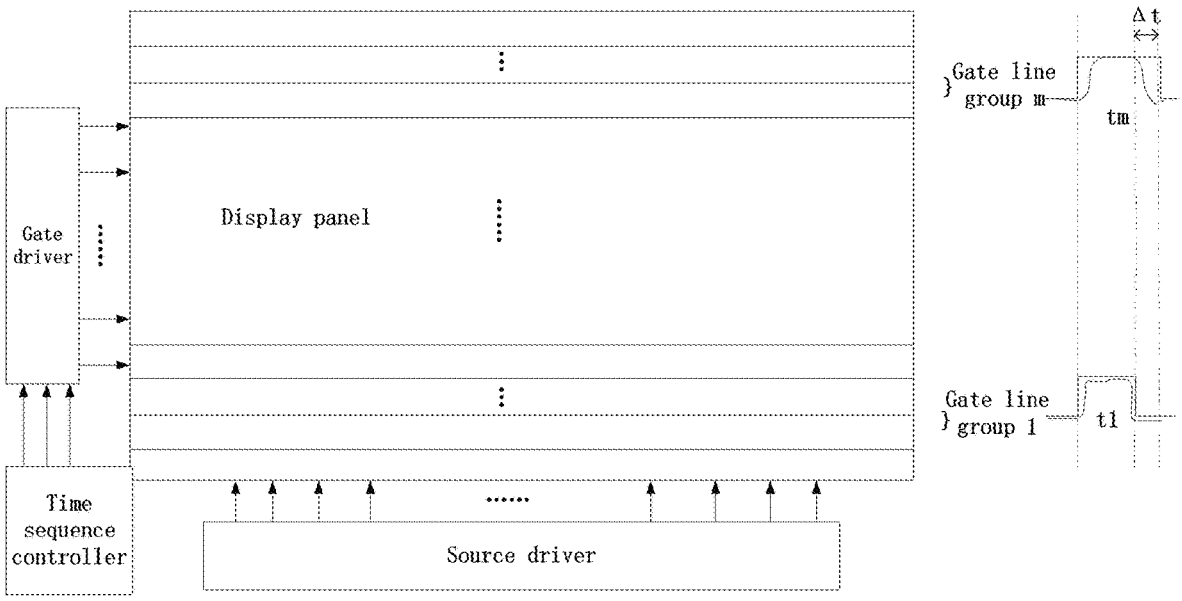
FIG. 3 is a schematic view of a display device in at least one embodiment of the present disclosure.

Referring to FIG. 3 which is a schematic view of a display device in at least one embodiment of the present disclosure. As shown in FIG. 3, based on a scanning sequence of the Y gate lines, the Y gate lines on the display panel are divided into m gate lines group (gate line group 1, gate line group 2 . . . gate line group m), where each gate line group includes 12 gate lines (not all shown in the figure), where gate line group 1 is closest to the source driver, and gate line group m is farthest from the source driver. The adjustment charging duration of respective gate line groups gradually increases in a direction away from a source driver. It can be seen from FIG. 3 that the adjustment charging duration of the gate line group 1 is t1, the adjustment charging duration of the gate line group m is tm, where tm is greater than t1, and the difference between the two is Δt.

In at least one embodiment of the present disclosure, the number of gate line groups may be set as needed. The value range is greater than 1 and less than or equal to Y. When the number of gate line groups is equal to Y, that is, each gate line group includes one gate line. It can be appreciated that the smaller the number of gate lines, the higher the accuracy of the charging rate adjustment.

Optionally, every gate line group has the same number of gate lines. Of course, in at least one embodiments of the present disclosure, the number of the gate lines in every gate line group may also be unequal and can be set as needed.

In order to ensure that the total charging duration of one frame of image does not change, optionally a sum of the adjustment charging duration of the gate lines is identical to a sum of the original charging duration of the gate lines.

Optionally, when Y is an even number, the adjustment charging duration of a 1 to $(Y/2)^{th}$ rows of gate lines is smaller than the original charging duration, and the adjustment charging duration of a $(Y/2+1)^{th}$ to $Y^{th}$ rows of gate lines is greater than the original charging duration. The first row of gate lines is closest to the source driver, and the $Y^{th}$ row of gate lines is farthest from the source driver. That is, the gate line on the entire display panel is divided into two portions, and the original charging duration of one half is reduced, and the original charging duration of the other half is increased, so as to ensure that the total charging duration of one frame of the image does not change.

According to at least one embodiment of the present disclosure, the adjustment charging duration of each gate line may be pre-stored. When the $i^{th}$ gate line needs to be scanned, the adjustment charging duration of the $i^{th}$ gate line may be directly acquired from the pre-stored content. For the actual use, the lookup table is the simplest and most practical method, and the table content can be arbitrarily set, which is more flexible. Therefore, in at least one embodiment of the present disclosure, a table may be used to store the correspondence between each gate line and its corresponding adjustment charging duration. When the $i^{th}$ gate line needs to be scanned, the adjustment charging duration of the $i^{th}$ gate may be directly acquired from a pre-stored table.

Figure 4:
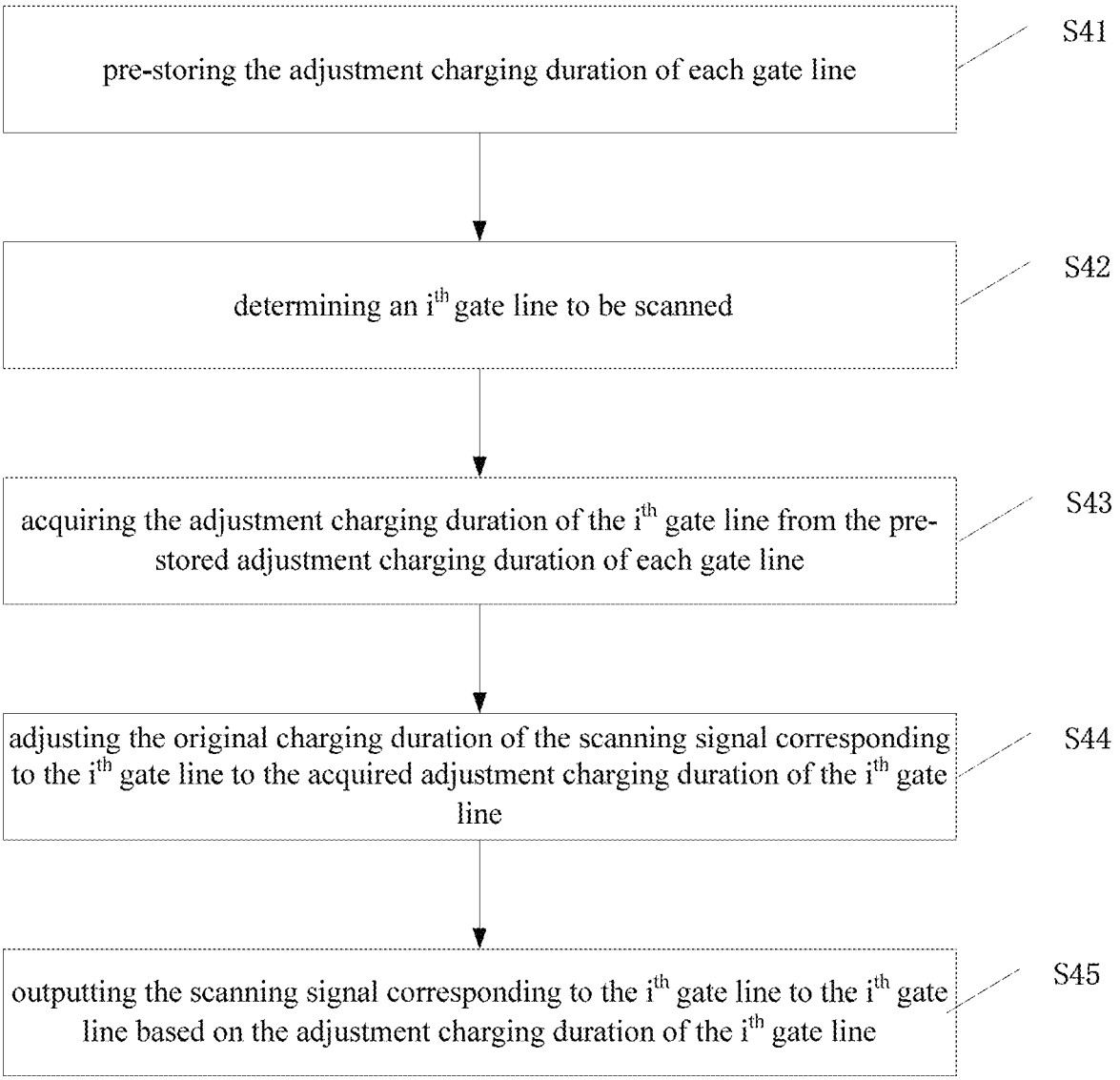
FIG. 4 is a flow chart of a driving method of a display panel in at least one embodiment of the present disclosure.

Refer to FIG. 4 which is a flow chart of a driving method of a display panel in at least one embodiment of the present disclosure, where the display panel includes Y gate lines (Y is a positive integer), the Y gate lines are divided into a plurality of gate line groups based on a scanning sequence of the Y gate lines, and each gate line group comprises at least one gate line. The driving method includes:

Step S41: pre-storing the adjustment charging duration of each gate line, where the adjustment charging duration of every gate line in each gate line group are identical, and the adjustment charging duration of respective gate line groups gradually increases in a direction away from a source driver;

Step S42: determining an $i^{th}$ gate line to be scanned, where $1 \leq i \leq Y$;

Step S43: acquiring the adjustment charging duration of the $i^{th}$ gate line from the pre-stored adjustment charging duration of each gate line;

Step S44: adjusting the original charging duration of the scanning signal corresponding to the $i^{th}$ gate line to the acquired adjustment charging duration of the $i^{th}$ gate line; and Step S45: outputting the scanning signal corresponding to the $i^{th}$ gate line to the $i^{th}$ gate line based on the adjustment charging duration of the $i^{th}$ gate line.

In at least one embodiment of the present disclosure, the adjustment charging duration of each gate line is pre-stored. When the display is to be performed, the adjustment charging duration of each gate line may be directly acquired from the pre-stored information, and it is not necessary to calculate the adjustment charging duration of each gate line in real time when performing the display, thereby saving the time and power consumption.

In at least one embodiment of the present disclosure, the pre-storing the adjustment charging duration of each gate line, further includes:

Step one: determining a width of H-Blank data of video data corresponding to a $i^{th}$ row of gate lines to be adjusted, to obtain a resultant width of the H-Blank data corresponding to the $i^{th}$ row of gate lines;

Step two: determining the adjustment charging duration of the $i^{th}$ row of gate lines based on the resultant width of the H-Blank data corresponding to the $i^{th}$ row of gate lines.

The following is a detailed description.

Figure 5:
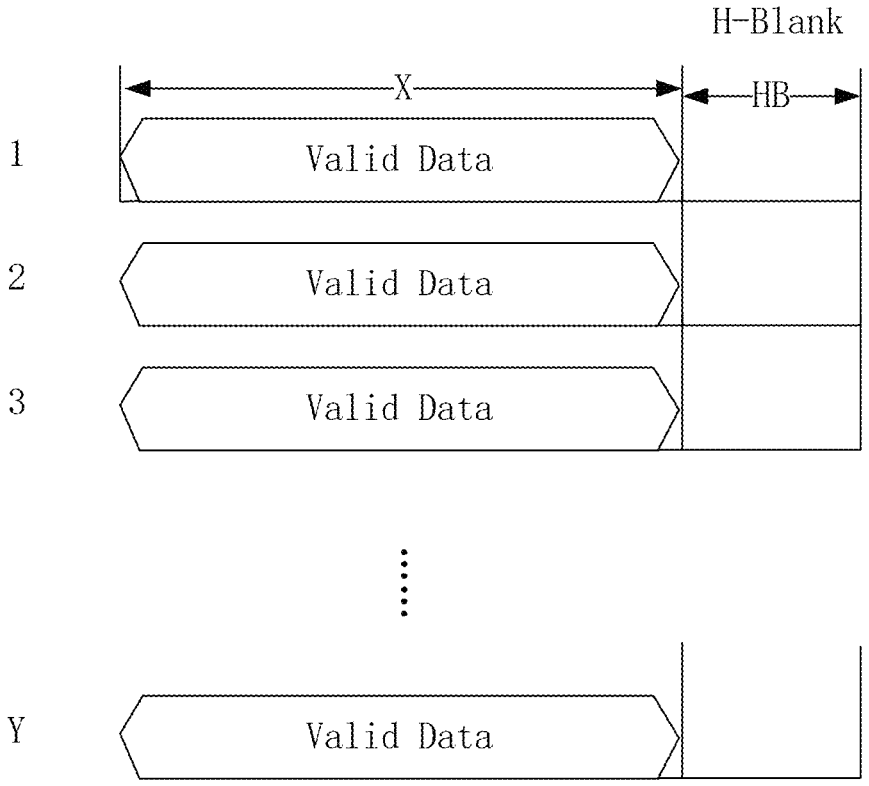
FIG. 5 is a schematic view of video data of which a width of H-Blank data is not adjusted in at least one embodiment of the present disclosure.

In the display, the video data is usually received and transmitted to the source driver by a time sequence controller, and the source driver transmits the video data to the pixels through the data line. The video data corresponding to a frame of image received by the time sequence controller may be as shown in FIG. 5, where the first row of video data corresponds to the first gate line, and the $Y^{th}$ row of video data corresponds to the Y gate line. Each row of video data includes X pieces of valid data (Data) and H-Blank (horizontal blank area) data, and the unit of the width of the H-Blank data can be expressed in pixel number, time, CLK (clock) or other forms of unit. For example, one row of video data includes 3840 pieces of valid data and 560 pieces of H-Blank data. For another example, it takes 7.4 us to transmit one row of video data, in which the transmission of the valid data takes about 6.5 us, and the transmission of the H-Blank data takes about 0.9 us. Because the video data is transmitted serially during transmission, the H-Blank data may also be interpreted as the interval between one row of valid data and the next row of valid data.

It can be seen from FIG. 5 that, the width of valid data and H-Blank data in each row of video data received by the time sequence controller is fixed. In each row of video data, the number of valid data is X, the width of the H-Blank is HB, and the unit is Pixel. The video data corresponding to each frame of image has Y rows. The total amount of video data corresponding to each frame is (X+HB)*Y. The total amount of H-Blank data is HB*Y.

After receiving the video data, the time sequence controller stores it in the line buffer. One row of line buffer may store X pieces of valid data. Assuming that the row number of line buffer in the time sequence controller is NL, where $NL \geq 2$, the total amount of valid data that the line buffer capable of storing is NL*X.

In at least one embodiment of the present disclosure, the original charging duration of each gate line may be adjusted by adjusting the width of the H-Blank data corresponding to each gate line. Specifically, the greater the width of the H-Blank data, the longer the original charging duration of the gate line may be, while the smaller the width of the H-Blank data, the shorter the original charging duration of the gate line may be.

Figure 6:
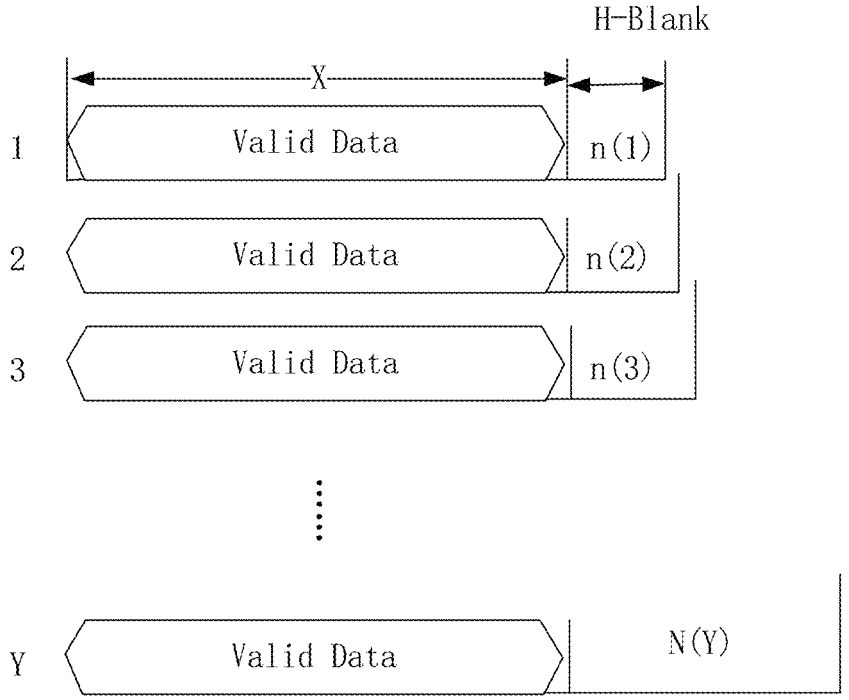
FIG. 6 is a schematic view of video data of which a width of H-Blank data is adjusted in at least one embodiment of the present disclosure.

Referring to FIG. 6 which is a schematic view of video data of which a width of H-Blank data is adjusted in at least one embodiment of the present disclosure. As can be seen from FIG. 6, the width n(1) of the H-Blank data of the first row of video data (corresponding to the gate line closest to the source driver) is the smallest, and the width n(Y) of the H-Blank data of the $Y^{th}$ row of video data (corresponding to the gate line farthest from the source driver) is the largest, that is, the width of the H-Blank data gradually increases in a direction away from the source driver.

As shown in FIG. 6, the Y gate lines are divided into Y gate line groups, that is, each gate line group includes one gate line, and the widths of the H-Blank data of every gate line are not the same.

Figure 7:
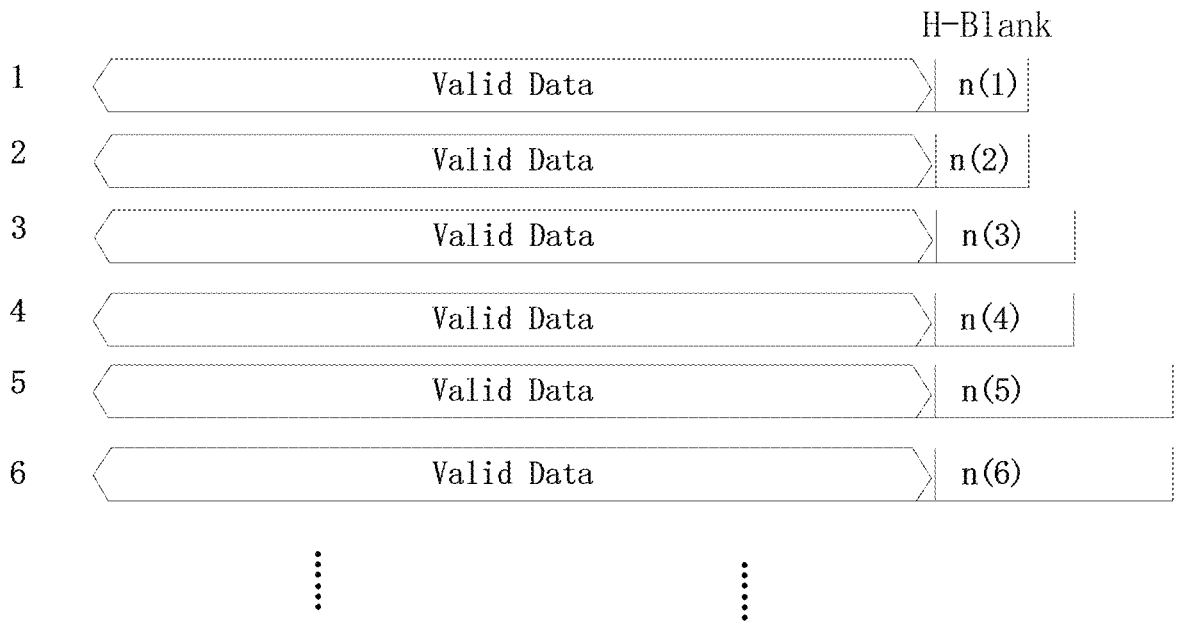
FIG. 7 is a schematic view of video data of which a width of H-Blank data is adjusted in at least one embodiment of the present disclosure.

Refer to FIG. 7 which is a schematic view of video data of which a width of H-Blank data is adjusted in at least one embodiment of the present disclosure, the widths of H-Blank data of every two rows of video data are adjusted. That is, the Y gate lines are divided into Y/2 gate line groups, i.e., each gate line group includes two gate lines, and the widths of the H-Blank data of the two gate lines within the same gate line group are the same.

In at least one embodiment of the present disclosure, a resultant width n(i) of the H-Blank data corresponding to the $i^{th}$ row of gate lines may be determined by the following two methods.

Method one: calculating the width n(i) of H-Blank data of video data corresponding to the $i^{th}$ row of gate lines through a linear algorithm.

Figure 8:
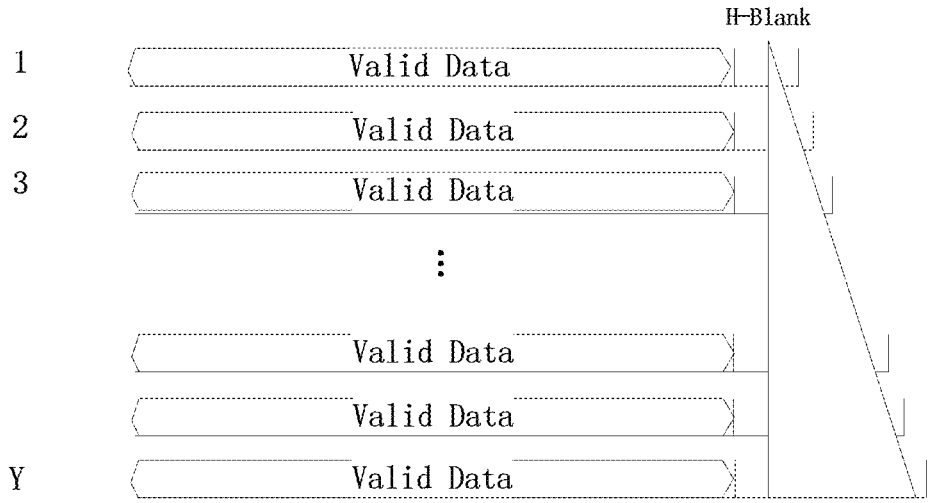
FIG. 8 is a schematic view of a width of H-Blank data of video data corresponding to a $i^{th}$ row of gate lines to be adjusted calculated through a linear algorithm in at least one embodiment of the present disclosure.

Referring to FIG. 8, the linear algorithm includes:

(1) determining a width k0 of the H-Blank data of the video data corresponding to a first row of gate lines to be reduced;

(2) calculating a resultant width n(1) of the H-Blank data corresponding to the first row of gate lines, where n(1)=HB−k0;

(3) calculating a difference Δk between the resultant width of the H-Blank data corresponding to the $i^{th}$ row of gate lines and n(1), where $$\Delta k = \frac{2mk0}{Y} * \mathrm{int}\left(\frac{i}{m}\right),$$

Y is a total number of the gate lines of the display panel, and m is a total number of the gate line groups;

The principle of the calculation formula of Δk is: in the Y/2 rows, the width of H-blank is adjusted every m rows, so the total adjustment times is $$\frac{Y}{2m}.$$

The maximum adjustment width is k0, and the width of each adjustment is $$k0/\frac{Y}{2m} = \frac{2mk0}{Y},$$

and the a width of the H-Blank data of the video data corresponding to the $i^{th}$ row of gate lines to be adjusted is obtained after width of each adjustment is multiplied by int $$\left(\frac{i}{m}\right).$$

(4) calculating a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

In at least one embodiment of the present disclosure, the width k0 of the H-Blank data of the video data corresponding to the first row of gate lines to be reduced may be determined by the following methods:

1) calculating a width k of the H-Blank data of the video data corresponding to the first row of gate lines to be reduced at best, where $$(NL-1)*X = \frac{1}{2}*k*\frac{Y}{2},$$

NL is a volume of data that one line buffer of a time sequence controller capable of storing, X is a volume of valid data of one line of video data, Y is the total number of the gate lines of the display panel, k<HB, and HB is the width of the H-Blank data of the video data corresponding to the $i^{th}$ row of gate lines;

selecting a value smaller than or equal to k as the width k0 of the H-Blank data of the video data corresponding to the first row of gate lines to be reduced.

k0 is less than or equal to k, so as to prevent the line buffer from overflowing.

Each row of valid data sent by TCON, in some formats, needs to include header data, tail data etc., and those data may occupy a certain width. In view of the versatility, k is set to be smaller than HB.

The calculation principle of the formula $$(NL-1)*X = \frac{1}{2}*k*\frac{Y}{2}$$

is: the sum of the variation of the width of the H-Blank data is smaller than the total amount of the line buffer; the left side of the formula ((NL−1)*X) is the sum of valid data that the line buffer can store, and the right side of the formula $$\left(\frac{1}{2}*k*\frac{Y}{2}\right)$$

is the sum of the variation of the width of the H-Blank data. In at least one embodiment of the present disclosure, Y/2 rows are used to reduce the width of the H-blank data, and the rest Y/2 rows are used to increase the width of the H-blank data, that is, the overall charging duration of a frame of image is not changed, one half of the rows are used to reduce the duration, and the other half of the rows are used to increase the duration.

In other words, in at least one embodiment of the present disclosure, the widths of the H-blank data corresponding to the first to $(Y/2)^{th}$ rows of gate lines are reduced, and the widths of the H-blank data corresponding to the $(Y/2+1)^{th}$ to $Y^{th}$ rows of gate lines are increased.

2) debugging according to the actual display effect, to obtain k0.

Method two: calculating the width n(i) of H-Blank data of video data corresponding to the $i^{th}$ row of gate lines through a non-linear algorithm.

Figure 9:
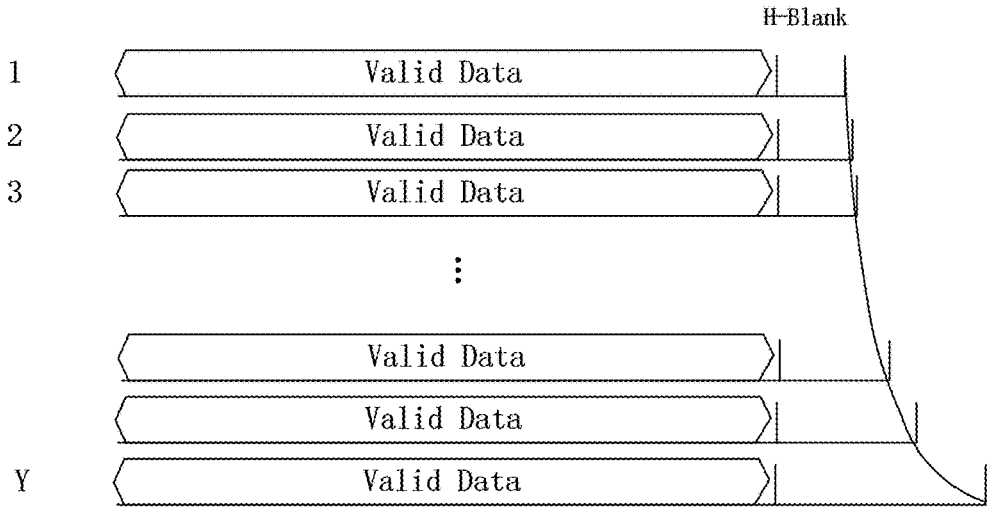
FIG. 9 is a schematic view of a width of H-Blank data of video data corresponding to a $i^{th}$ row of gate lines to be adjusted calculated through a non-linear algorithm in at least one embodiment of the present disclosure.

Referring to FIG. 9, the non-linear algorithm includes:

(1) determining a width k0 of the H-Blank data of the video data corresponding to a first row of gate lines to be reduced;

(2) calculating a resultant width n(1) of the H-Blank data corresponding to the first row of gate lines, where n(1)=HB−k0;

(3) calculating a difference Δk between the resultant width of the H-Blank data corresponding to the $i^{th}$ row of gate lines and n(1), where $$\Delta k = \mathrm{int}\left(k0 * \left(\frac{\mathrm{int}\left(\frac{i}{m}\right)}{\mathrm{int}\left(\frac{Y}{m}\right)}\right)^A\right),$$

A is an exponent, Y is a total number of the gate lines of the display panel, and m is a total number of the gate line groups;

The value of A is debugged according to the actual display effect.

The calculation principle of the formula $$\Delta k = \mathrm{int}\left(k0 * \left(\frac{\mathrm{int}\left(\frac{i}{m}\right)}{\mathrm{int}\left(\frac{Y}{m}\right)}\right)^A\right)$$

is: the amount of width variation of H-blank data every m rows increases exponentially, the variation coefficient is $$\left(\frac{\mathrm{int}\left(\frac{i}{m}\right)}{\mathrm{int}\left(\frac{Y}{m}\right)}\right)^A,$$

the variation coefficient is multiplied by k0 to obtain a resultant, and then the resultant is rounded to obtain the variation every m rows.

(4) calculating a resultant width n(i) of the H-Blank data corresponding to the $i^{th}$ row of gate lines, wherein n(i)=HB−k0+Δk, HB is a width of the H-Blank data of the video data corresponding to the $i^{th}$ row of gate lines.

Similarly, the width k0 of the H-Blank data of the video data corresponding to the first row of gate lines to be reduced may be determined by the following methods:

1) calculating a width k of the H-Blank data of the video data corresponding to the first row of gate lines to be reduced at best, where $$(NL-1) * X = \frac{1}{2} * k * \frac{Y}{2},$$

NL is a volume of data that one line buffer of a time sequence controller capable of storing, X is a volume of valid data of one line of video data, Y is the total number of the gate lines of the display panel, k<HB, and HB is the width of the H-Blank data of the video data corresponding to the $i^{th}$ row of gate lines; selecting a value smaller than or equal to k as the width k0 of the H-Blank data of the video data corresponding to the first row of gate lines to be reduced.

2) debugging according to the actual display effect, to obtain k0.

In at least one embodiment of the present disclosure, the larger the number NL of line buffers, the greater the width HB of the H-Blank data in the input video data may be, and the larger the adjustable range of the calculated width of the H-Blank data may be.

In at least one embodiment of the present disclosure, the adjustment charging duration of each gate line is pre-calculated and pre-stored, and during display, the adjustment charging duration corresponding to the gate line that needs to be scanned at present may be directly acquired. Of course, in at least one embodiment of the present disclosure, the adjustment charging duration corresponding to the gate line that needs to be scanned at present may be calculated in real time, which may apply the calculation method described in the above embodiment, and the detailed description thereof is omitted herein.

In at least one embodiment of the present disclosure, when the scanning signal corresponding to the $i^{th}$ gate line is output to the $i^{th}$ gate line based on the adjustment charging duration corresponding to the $i^{th}$ gate line. To be specific, a new time sequence control signal corresponding to the $i^{th}$ row of gate lines is generated based on the adjustment charging duration corresponding to the $i^{th}$ gate line, and then the video data is output based on the new time sequence control signal.

Figure 10:
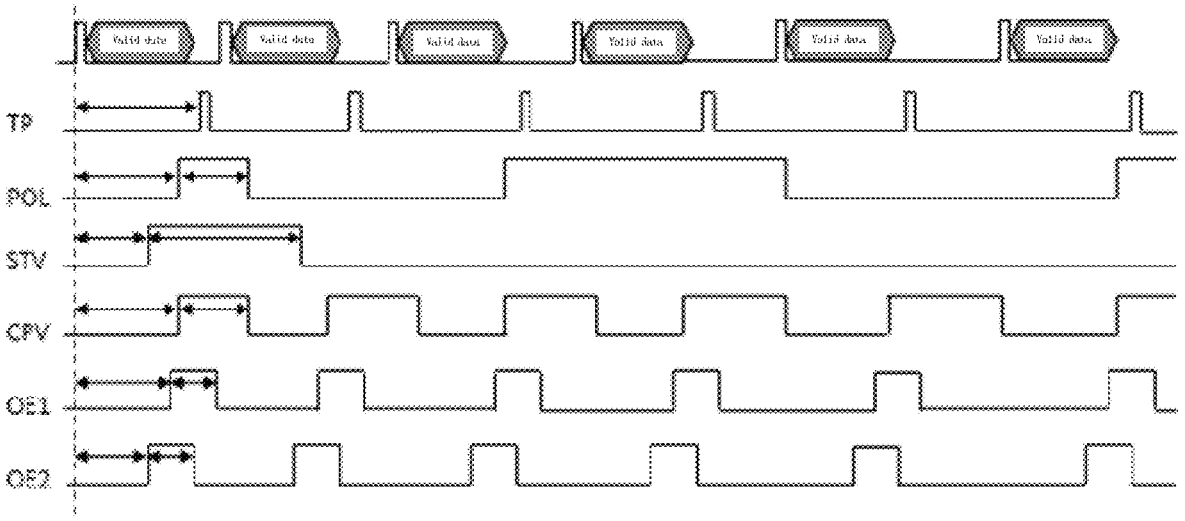
FIG. 10 show a comparison between a time sequence control signal and adjusted video data in at least one embodiment of the present disclosure.

Refer to FIG. 10 showing a comparison between a time sequence control signal and adjusted video data in at least one embodiment of the present disclosure, STV is a frame trigger signal, CPV is a clock signal, and TP is a data source line latch signal, POL is a polarity inversion signal, OE1 and OE2 are enable signals. As can be seen from FIG. 10, unlike the prior art, the widths of the H-Blank data in every row of video data are different, resulting in different total lengths of every row of video data. In order to be able to output video data of different lengths, the time sequence control signals (TP, CPV, OE1, OE2, etc.) matching with the video data are output at a non-fixed frequency.

Based on the same principle, a driving circuitry of a display panel is further provided in the present disclosure, where the display panel includes Y gate lines, the Y gate lines are divided into a plurality of gate line groups based on a scanning sequence of the Y gate lines, and each gate line group includes at least one gate line; the driving circuitry includes: a determination circuit, configured to determine an $i^{th}$ gate line to be scanned, where $1 \le i \le Y$; an adjustment circuit, configured to adjust an original charging duration of a scanning signal corresponding to the $i^{th}$ gate line to an adjustment charging duration, where the adjustment charging duration of every gate line in each gate line group are identical, and the adjustment charging durations of respective gate line groups gradually increase in a direction away from a source driver; and an output circuit, configured to output the scanning signal corresponding to the $i^{th}$ gate line to the $i^{th}$ gate line, based on the adjustment charging duration of the $i^{th}$ gate line.

According to at least one embodiment of the present disclosure, the adjustment charging duration of each gate line may be pre-stored. When the $i^{th}$ gate line needs to be scanned, the adjustment charging duration of the $i^{th}$ gate line may be directly acquired from the pre-stored content. For the actual use, the lookup table is the simplest and most practical method, and the table content can be arbitrarily set, which is more flexible. Therefore, in at least one embodiment of the present disclosure, a table may be used to store the correspondence between each gate line and its corresponding adjustment charging duration. When the $i^{th}$ gate line needs to be scanned, the adjustment charging duration of the $i^{th}$ gate may be directly acquired from a pre-stored table.

In at least one embodiment of the present disclosure, the driving circuitry of the display panel further comprises: a storage circuit, configured to pre-store the adjustment charging duration of each gate line.

Optionally, the storage circuit is configured to store the correspondence between each gate line and its corresponding adjustment charging duration through a table.

The adjustment charging duration of each gate line stored by the storage circuit may be obtained by adjusting the width of the H-Blank data, the calculation method may refer to the driving method hereinabove, and the detailed description thereof is omitted herein.

In at least one embodiment of the present disclosure, the driving circuitry of the display panel further comprises: a H-Blank data width adjustment circuit, configured to determine a width of H-Blank data of video data corresponding to a $i^{th}$ row of gate lines to be adjusted, to obtain a resultant width of the H-Blank data corresponding to the $i^{th}$ row of gate lines; a third determination circuit, configured to determine the adjustment charging duration of the $i^{th}$ row of gate lines based on the resultant width of the H-Blank data corresponding to the $i^{th}$ row of gate lines.

That is, the resultant width of the H-Blank data corresponding to the $i^{th}$ row of gate lines may be calculated in real time, so as to determine the adjustment charging duration of the $i^{th}$ row of gate lines.

The H-Blank data width adjustment circuit may calculate the resultant width of H-Blank data of video data corresponding to the $i^{th}$ row of gate lines through a linear algorithm. Optionally, the H-Blank data width adjustment circuit further includes: a first determination circuit, configured to determine a width k0 of the H-Blank data of the video data corresponding to a first row of gate lines to be reduced; a first calculation circuit, configured to calculate a resultant width n(1) of the H-Blank data corresponding to the first row of gate lines, where n(1)=HB−k0; a second calculation circuit, configured to calculate a difference Δk between the resultant width of the H-Blank data corresponding to the $i^{th}$ row of gate lines and n(1), where $$\Delta k = \frac{2mk0}{Y} * \mathrm{int}\left(\frac{i}{m}\right),$$

Y is a total number of the gate lines of the display panel, and m is a total number of the gate line groups; and a fourth calculation circuit, configured to calculate a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

The H-Blank data width adjustment circuit may calculate the resultant width of H-Blank data of video data corresponding to the $i^{th}$ row of gate lines through a non-linear algorithm. Optionally, the H-Blank data width adjustment circuit further includes: a second determination circuit, configured to determine a width k0 of the H-Blank data of the video data corresponding to a first row of gate lines to be reduced; a fifth calculation circuit, configured to calculate a resultant width n(1) of the H-Blank data corresponding to the first row of gate lines, where n(1)=HB−k0; a sixth calculation circuit, configured to calculate a difference Δk between the resultant width of the H-Blank data corresponding to the $i^{th}$ row of gate lines and n(1), where $$\Delta k = \mathrm{int}\left(k0 * \left(\frac{\mathrm{int}\left(\frac{i}{m}\right)}{\mathrm{int}\left(\frac{Y}{m}\right)}\right)^{A}\right),$$

A is an exponent, Y is a total number of the gate lines of the display panel, and m is a total number of the gate line groups; and a seventh calculation circuit, configured to calculate a resultant width n(i) of the H-Blank data corresponding to the $i^{th}$ row of gate lines, where n(i)=HB−k0+Δk, HB is a width of the H-Blank data of the video data corresponding to the $i^{th}$ row of gate lines.

Figure 11:
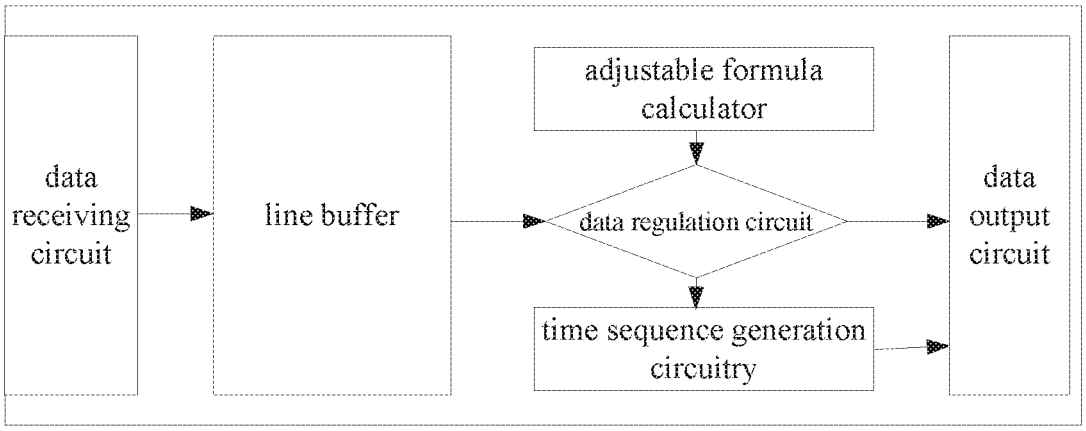
FIG. 11 is a schematic view of a driving circuitry of a display panel in at least one embodiment of the present disclosure.

Referring to FIG. 11 which is a schematic view of a display device in at least one embodiment of the present disclosure, the display device includes: a data receiving circuit, a line buffer, an adjustable formula calculator, a data regulation circuit, a time sequence generation circuitry and a data output circuit. The data receiving circuit is configured to receive video data transmitted to the time sequence controller. The line buffer is configured to store the video data, and the number of the line buffers is larger than or equal to 2. The adjustable formula calculator is configured to calculate a width of H-Blank data of the video data corresponding to each row of gate lines to be adjusted. The data regulation circuit is configured to generate resultant video data based on the width of the H-Blank data of the video data corresponding to each row of gate lines to be adjusted that calculated by the adjustable formula calculator, that is, configured to combine the valid data and the H-Blank data of the adjusted width, to obtain the resultant video data. The time sequence generation circuitry is configured to generate a time sequence control signal based on the resultant video data. The data output circuit is configured to output video data in response to the time sequence control signal generated by the time sequence generation circuit.

The calculation method of a width of H-Blank data of the video data corresponding to each row of gate lines to be adjusted may refer to the embodiments hereinabove, and the detailed description thereof is omitted herein.

Based on the same principle, a display device is provided in at least one embodiment of the present disclosure, including the driving circuitry hereinabove.

Optionally, the display device is a large-size liquid crystal display device.

According to at least one embodiment of the present disclosure, the charging duration corresponding to each row of gate lines is adjusted so that the charging duration of the pixel rows near the source driver is short, and the charging duration of the pixel rows far from the source driver is larger, thereby improving the insufficient charging rate of the pixel rows, to enable the charging rate of every row of pixels to be the same or similar, thereby solving the poor display of the screen caused by the difference in the charging rate on the display panel and improving the display effect.

The above are merely the preferred embodiments of the present disclosure. It should be noted that, a person skilled in the art may make further modifications and improvements without departing from the principle of the present disclosure, and these modifications and improvements shall also fall within the scope of the present disclosure.

What is claimed is:

1. A driving method of a display panel, wherein the display panel comprises Y gate lines, the Y gate lines are divided into a plurality of gate line groups based on a scanning sequence of the Y gate lines, and each gate line group comprises at least one gate line;

the driving method comprises:

determining an $i^{th}$ gate line to be scanned, wherein $1 \le i \le Y$;

pre-storing an adjustment charging duration of each gate line;

adjusting an original charging duration of a scanning signal corresponding to the $i^{th}$ gate line to the adjustment charging duration, wherein the adjustment charging duration of every gate line in each gate line group are identical, and the adjustment charging duration of respective gate line groups gradually increases in a direction away from a source driver; and outputting the scanning signal corresponding to the $i^{th}$ gate line to the $i^{th}$ gate line, based on the adjustment charging duration of the $i^{th}$ gate line, wherein the pre-storing an adjustment charging duration of each gate line, further comprises:

determining a width of horizontal blank (H-Blank) data of video data corresponding to a $i^{th}$ row of gate lines to be adjusted, to obtain a resultant width of the H-Blank data corresponding to the $i^{th}$ row of gate lines;

determining the adjustment charging duration of the $i^{th}$ row of gate lines based on the resultant width of the H-Blank data corresponding to the $i^{th}$ row of gate lines, wherein the determining the width of the H-Blank data of the video data corresponding to the $i^{th}$ row of gate lines to be adjusted, to obtain the resultant width of the H-Blank data corresponding to the $i^{th}$ row of gate lines, further comprises:

determining a width k0 of the H-Blank data of the video data corresponding to a first row of gate lines to be reduced;

calculating a resultant width n(1) of the H-Blank data corresponding to the first row of gate lines, wherein n(1)=HB−k0;

calculating a difference Δk between the resultant width of the H-Blank data corresponding to the $i^{th}$ row of gate lines and n(1), wherein $$\Delta k = \frac{2mk0}{Y} * \mathrm{int}\left(\frac{i}{m}\right),$$

Y is a total number of the gate lines of the display panel, and m is a total number of the gate line groups; and calculating a resultant width n(i) of the H-Blank data corresponding to the $i^{th}$ row of gate lines, wherein n(i)=HB−k0+Δk, HB is a width of the H-Blank data of the video data corresponding to the $i^{th}$ row of gate lines.

2. The driving method according to claim 1, wherein a sum of the adjustment charging duration of the Y gate lines is identical to a sum of the original charging duration of the Y gate lines.

3. The driving method according to claim 1, wherein the determining the width k0 of the H-Blank data of the video data corresponding to the first row of gate lines to be reduced, further comprises:

calculating a width k of the H-Blank data of the video data corresponding to the first row of gate lines to be reduced at best, wherein $$(NL-1)*X = \frac{1}{2}*k*\frac{Y}{2},$$

NL is a volume of data that one line buffer of a time sequence controller capable of storing, X is a volume of valid data of one line of video data, Y is the total number of the gate lines of the display panel, k<HB, and HB is the width of the H-Blank data of the video data corresponding to the $i^{th}$ row of gate lines;

selecting a value smaller than or equal to k as the width k0 of the H-Blank data of the video data corresponding to the first row of gate lines to be reduced.

4. A driving method of a display panel, wherein the display panel comprises Y gate lines, the Y gate lines are divided into a plurality of gate line groups based on a scanning sequence of the Y gate lines, and each gate line group comprises at least one gate line;

the driving method comprises:

determining an $i^{th}$ gate line to be scanned, wherein $1 \le i \le Y$;

pre-storing an adjustment charging duration of each gate line;

adjusting an original charging duration of a scanning signal corresponding to the $i^{th}$ gate line to the adjustment charging duration, wherein the adjustment charging duration of every gate line in each gate line group are identical, and the adjustment charging duration of respective gate line groups gradually increases in a direction away from a source driver; and outputting the scanning signal corresponding to the $i^{th}$ gate line to the $i^{th}$ gate line, based on the adjustment charging duration of the $i^{th}$ gate line, wherein the pre-storing an adjustment charging duration of each gate line, further comprises:

determining a width of horizontal blank (H-Blank) data of video data corresponding to a $i^{th}$ row of gate lines to be adjusted, to obtain a resultant width of the H-Blank data corresponding to the $i^{th}$ row of gate lines;

determining the adjustment charging duration of the $i^{th}$ row of gate lines based on the resultant width of the H-Blank data corresponding to the $i^{th}$ row of gate lines, wherein the determining the width of the H-Blank data of the video data corresponding to the $i^{th}$ row of gate lines to be adjusted, to obtain the resultant width of the H-Blank data corresponding to the $i^{th}$ row of gate lines, further comprises:

determining a width k0 of the H-Blank data of the video data corresponding to a first row of gate lines to be reduced;

calculating a resultant width n(1) of the H-Blank data corresponding to the first row of gate lines, wherein n(1)=HB−k0;

calculating a difference Δk between the resultant width of the H-Blank data corresponding to the $i^{th}$ row of gate lines and n(1), wherein $$\Delta k = \mathrm{int}\left(k0 * \left(\frac{\mathrm{int}\left(\frac{i}{m}\right)}{\mathrm{int}\left(\frac{Y}{m}\right)}\right)^{A}\right),$$

A is an exponent, Y is a total number of the gate lines of the display panel, and m is a total number of the gate line groups; and calculating a resultant width n(i) of the H-Blank data corresponding to the $i^{th}$ row of gate lines, wherein n(i)=HB−k0+Δk, HB is a width of the H-Blank data of the video data corresponding to the $i^{th}$ row of gate lines.

5. The driving method according to claim 4, wherein the determining the width k0 of the H-Blank data of the video data corresponding to the first row of gate lines to be reduced, further comprises:

calculating a width k of the H-Blank data of the video data corresponding to the first row of gate lines to be reduced at best, wherein $$(NL-1)*X=\frac{1}{2}*k*\frac{Y}{2},$$

NL is a volume of data that one line buffer of a time sequence controller capable of storing, X is a volume of valid data of one line of video data, Y is the total number of the gate lines of the display panel, k<HB, and HB is the width of the H-Blank data of the video data corresponding to the $i^{th}$ row of gate lines;

selecting a value smaller than or equal to k as the width k0 of the H-Blank data of the video data corresponding to the first row of gate lines to be reduced.

6. A driving circuitry of a display panel, wherein the display panel comprises Y gate lines, the Y gate lines are divided into a plurality of gate line groups based on a scanning sequence of the Y gate lines, and each gate line group comprises at least one gate line;

the driving circuitry comprises:

a determination circuit, configured to determine an $i^{th}$ gate line to be scanned, wherein $1 \le i \le Y$;

a storage circuit, configured to pre-store an adjustment charging duration of each gate line;

an adjustment circuit, configured to adjust an original charging duration of a scanning signal corresponding to the $i^{th}$ gate line to the adjustment charging duration, wherein the adjustment charging duration of every gate line in each gate line group are identical, and the adjustment charging durations of respective gate line groups gradually increase in a direction away from a source driver;

an output circuit, configured to output the scanning signal corresponding to the $i^{th}$ gate line to the $i^{th}$ gate line, based on the adjustment charging duration of the $i^{th}$ gate line;

a horizontal blank (H-Blank) data width adjustment circuit, configured to determine a width of H-Blank data of video data corresponding to a $i^{th}$ row of gate lines to be adjusted, to obtain a resultant width of the H-Blank data corresponding to the $i^{th}$ row of gate lines;

a third determination circuit, configured to determine the adjustment charging duration of the $i^{th}$ row of gate lines based on the resultant width of the H-Blank data corresponding to the $i^{th}$ row of gate lines, wherein the H-Blank data width adjustment circuit further comprises:

a first determination circuit, configured to determine a width k0 of the H-Blank data of the video data corresponding to a first row of gate lines to be reduced;

a first calculation circuit, configured to calculate a resultant width n(1) of the H-Blank data corresponding to the first row of gate lines, wherein n(1)=HB−k0;

a second calculation circuit, configured to calculate a difference Δk between the resultant width of the H-Blank data corresponding to the $i^{th}$ row of gate lines and n(1), wherein $$\Delta k=\frac{2mk0}{Y}*\mathrm{int}\left(\frac{i}{m}\right),$$

Y is a total number of the gate lines of the display panel, and m is a total number of the gate line groups; and a fourth calculation circuit, configured to calculate a resultant width n(i) of the H-Blank data corresponding to the $i^{th}$ row of gate lines, wherein n(i)=HB−k0+Δk, HB is a width of the H-Blank data of the video data corresponding to the $i^{th}$ row of gate lines.

7. The driving circuitry according to claim 6, wherein the H-Blank data width adjustment circuit further comprises:

a second determination circuit, configured to determine the width k0 of the H-Blank data of the video data corresponding to the first row of gate lines to be reduced;

a fifth calculation circuit, configured to calculate the resultant width n(1) of the H-Blank data corresponding to the first row of gate lines, wherein n(1)=HB−k0;

a sixth calculation circuit, configured to calculate a difference Δk between the resultant width of the H-Blank data corresponding to the $i^{th}$ row of gate lines and n(1), wherein $$\Delta k=\mathrm{int}\left(k0*\left(\frac{\mathrm{int}\left(\frac{i}{m}\right)}{\mathrm{int}\left(\frac{Y}{m}\right)}\right)^{A}\right),$$

A is an exponent, Y is the total number of the gate lines of the display panel, and m is the total number of the gate line groups; and a seventh calculation circuit, configured to calculate a resultant width n(i) of the H-Blank data corresponding to the $i^{th}$ row of gate lines, wherein n(i)=HB−k0+Δk, HB is the width of the H-Blank data of the video data corresponding to the $i^{th}$ row of gate lines, and Δk is the difference calculated by the sixth calculation circuit.

8. The driving circuitry according to claim 6, wherein the storage circuit is further configured to pre-store the adjustment charging duration of each gate line through a table.

9. A display device, comprising the driving circuitry of the display panel according to claim 6 and further comprising:

a data receiving circuit, configured to receive video data transmitted to a time sequence controller;

a line buffer, configured to store the video data;

an adjustable formula calculator, configured to calculate a width of horizontal blank (H-Blank) data of the video data corresponding to each row of gate lines to be adjusted;

a data regulation circuit, configured to generate resultant video data based on the width of the H-Blank data of the video data corresponding to each row of gate lines to be adjusted that was calculated by the adjustable formula calculator;

a time sequence generation circuitry, configured to generate a time sequence control signal based on the resultant video data; and a data output circuit, configured to output video data in response to the time sequence control signal generated by the time sequence generation circuit.

* * * * *